US008206207B2

(12) United States Patent
Breslo

(10) Patent No.: US 8,206,207 B2
(45) Date of Patent: Jun. 26, 2012

(54) METHOD OF PLAYING PREPRINTED GAME TICKETS HAVING MULTIPLE GAMES PRINTED THEREOF

(75) Inventor: James A. Breslo, Pacific Palisades, CA (US)

(73) Assignee: Diamond Game Enterprises, Inc., Chatsworth, CA (US)

( * ) Notice: Subject to any disclaimer, the term of this patent is extended or adjusted under 35 U.S.C. 154(b) by 330 days.

(21) Appl. No.: 12/756,703

(22) Filed: Apr. 8, 2010

(65) Prior Publication Data

US 2011/0250943 A1 Oct. 13, 2011

(51) Int. Cl.
*A63F 3/06* (2006.01)

(52) U.S. Cl. ..... 463/16

(58) Field of Classification Search ..... 463/16
See application file for complete search history.

(56) References Cited

U.S. PATENT DOCUMENTS 5,348,299 A 9/1994 Clapper, Jr.
5,735,432 A 4/1998 Stoken et al.
5,941,771 A 8/1999 Haste, III
7,625,279 B1 * 12/2009 Luciano et al. ..... 463/17
2006/0012116 A1 * 1/2006 Lovell, Sr. ..... 273/138.1
2006/0094491 A1 5/2006 Breslo
2008/0287177 A1 * 11/2008 Walker et al. ..... 463/17
2009/0309352 A1 * 12/2009 Walker et al. ..... 283/100

* cited by examiner

*Primary Examiner* — Dmitry Suhol
*Assistant Examiner* — Carl V Larsen
(74) *Attorney, Agent, or Firm* — Panitch Schwarze Belisario & Nadel LLP

(57) ABSTRACT

A method is provided of vending game tickets from a vending machine during a game play session. Each ticket is preprinted with a plurality of individually playable games, and each game has a game result. The games are associated with at least one deal of games that includes at least some games that have predetermined winning game results. One or more games on a ticket are electronically purchased in a current game play session in response to a request inputted into the vending machine from a patron. Less than all of the games on the ticket may be purchased during the current game play session. An indication of which games on the ticket have been purchased is electronically recorded in database records. The vending machine dispenses all tickets that are played, including tickets wherein less than all of the games on the ticket were purchased during the current game play session. The records of the database may be used to verify which of the games on each of the played tickets have been purchased in the game play session.

20 Claims, 7 Drawing Sheets

TICKET 1 (FRONT)

692 1A2 95D 000621 19037 70904311A0918

TICKET 1 (BACK)

000621 19037 000002

TICKET 2 (FRONT)

459 23C 62B 000621 19032 70904311A0918

TICKET 2 (BACK)

000621 19032 000002

FIGURE 1

(PRIOR ART)

FRONT OF GAME TICKET

BACK OF GAME TICKET

First patron requests ticket after playing one game on 1st ticket, or
Second patron plays only one game on 1st ticket, and does not request to receive the game ticket, and then the second patron requests to start a new game ticket that has no previously purchased games The second patron plays nine games of second ticket and either requests to receive the second game ticket, or requests to redeem winning ticket at cashier.

Database records

| Ticket number/Bar code number | Game number | Game value | Game result | Purchased? (Played?) | Redeemed? | Redemption location[1] |
|---|---|---|---|---|---|---|
| | | | | | | |
| 70904311A0918 | 1. 644333220<br>2. 644333221<br>:<br>:<br>10. 644333229 | 1. 692 1A2 95D<br>2. 459 23C 62B<br>:<br>:<br>10. 434 3C4 93D | lose<br>lose<br>:<br>:<br>$1 winner | Y<br>N<br>:<br>:<br>N | | |
| 70904311A0919 | 1. 644333230<br>2. 644333231<br>:<br>:<br>10. 644333239 | 1. 738 1A4 92D<br>2. 542 21C 76B<br>:<br>:<br>10. 395 1B6 22A | lose<br>$5 winner<br>:<br>lose<br>lose | Y<br>Y<br>:<br>Y<br>N | Y | CS |
| :<br>: | | | | | | |

[1] VM = vending machine
CS = cashier station

FIGURE 4

First patron starts with a new ticket, plays first seven games only (all losers) and does not request to receive the ticket. Second patron does not request a new ticket, starts with game 8 of the first patron's ticket, and stops play after first game play of subsequent ticket.

Database records

| Ticket number/Bar code number | Game number | Game value | Game result | Purchased? (Played?) | Redeemed? | Redemption location[1] |
|---|---|---|---|---|---|---|
| | | | | | | |
| 70904311A0918 | 1. 644333220<br>2. 644333221<br>:<br>:<br>10. 644333229 | 1. 692 1A2 95D<br>2. 459 23C 62B<br>:<br>:<br>10. 434 3C4 93D | lose<br>lose<br>:<br>:<br>$1 winner | Y<br>Y<br>:<br>:<br>Y | Y | VM |
| 70904311A0919 | 1. 644333230<br>2. 644333231<br>:<br>:<br>10. 644333239 | 1. 738 1A4 92D<br>2. 542 21C 76B<br>:<br>:<br>10. 395 1B6 22A | lose<br>$5 winner<br>:<br>:<br>lose | Y<br>N<br>:<br>:<br>N | N | |
| :<br>: | | | | | | |

[1] VM = vending machine
CS = cashier station

FIGURE 6

METHOD OF PLAYING PREPRINTED GAME TICKETS HAVING MULTIPLE GAMES PRINTED THEREOF

BACKGROUND OF THE INVENTION

There are many different types of game tickets known in the art. One conventional type of game ticket is associated with a pull-tab (pull tab) game. In a pull tab game, a set of game tickets, often referred to as a "deal of tabs," is created. There are a fixed amount of wins in each deal. The type and amount of wins are used to create the content of the pull tab tickets. A typical two-ply pull tab ticket has multiple tabs (windows) per game ticket that are initially hidden. Upon purchase, a player uncovers each of the pull tabs to determine if the ticket is a winner. A winning pull tab ticket may require the presence of a combination of symbols (similar to a slot machine), or the presence of a winning symbol under a single pull tab. Machines have been created to automatically dispense and even validate pull tabs. See, for example, U.S. Pat. No. 5,941,771 (Haste, III) and U.S. Pat. No. 5,348,299 (Clapper, Jr.), both of which are incorporated by reference herein. One commercially sold pull tab machine is the Lucky Tab II machine, available from Diamond Game Enterprises, Inc., Chatsworth, Calif.

Single-ply pull tab tickets also exist. Single-ply pull tab tickets have at least one game region with game content similar to the content of a pull tab game, but with no pull tab structure. One example of prior art single-ply pull tab tickets is shown in FIG. 1. (The tickets in FIG. 1 are part of the same deal of tickets.) In these tickets, different strings of alphanumeric characters represent different symbols, such as the symbols shown in FIG. 4 of U.S. Pat. No. 5,348,299. The form factor of the tickets in FIG. 1 allow for an extremely large number of tickets to be dispensed from a single reel of tickets, while allowing the ticket contents to be automatically read and displayed using the bar code reader and display screen in the machine described in U.S. Pat. No. 5,348,299.

Conventional pull tab tickets are sold in fixed denominations, typically ranging from $0.25 to $2.00 with award (prize) amounts ranging from the cost of the ticket to $5,000. Most of the prize amounts are small multiples of the ticket price. The average chance of winning for any particular ticket typically ranges from about 1 in 5 to about 1 in 7, but other ratios are known in the art.

Electronic pull tab machines also exist. These machines are electronically loaded with one or more electronic "digital deals" (i.e., an electronic version of a set of physical tickets). Unlike a slot machine, the electronic pull tab machine does not select the outcome. It merely dispenses the set of tickets which have predetermined content that provides a predetermined outcome. The electronic pull tabs are dispensed in a previously determined order, such as sequentially. A touch screen is often provided on such machines. Upon receipt of payment, a pull tab appears on the touch screen and the player touches each tab or window to reveal its hidden content. Another type of electronic pull tab machine uses spinning reels which simulate physical reels that display tab results upon stopping. A receipt is printed if the electronic pull tab ticket is a winner. When all of the pull tabs in each available deal are sold, new digital deals must be electronically loaded into the machine to allow for continued play. One example of a touch screen electronic pull tab machine that dispenses "digital pull tabs" is commercially available from Tekbilt USA, Huntingdon Valley, Pa. The digital deal is loaded into the Tekbilt USA machine using a floppy disk and security key.

Pull-tab tickets that allow a user to play multiple games on a single ticket are well-known in the art, as discussed above. Additional examples of such tickets are shown in U.S. Pat. No. 5,735,432 (Stoken et al.). However, the individual tickets have a fixed denomination and the purchase price of the ticket includes all of the games on the ticket.

U.S. Patent Publication No. 2006/0094491 (Breslo), which is incorporated by reference herein, discloses a vending machine for dispensing preprinted game tickets, such as pull tab tickets. Instead of having a fixed cost and a fixed prize amount, the game tickets may be purchased at different bet levels and credit values, both of which change the cost and prize amount. Buy-a-pay payments are also provided to buy additional winning symbol combinations. The methods described in U.S. Patent Publication No. 2006/0094491 are referred to as "multi-bet" methods. The vending machine may dispense the types of tickets shown in prior art FIG. 1. The tickets may be dispensed in the form of a roll of single-ply pull tabs. For example, an actual deal may contain the results for generating 600,000 or more pull tabs which can be used to create 20 rolls of single-ply pull tabs, each having 30,000 pull tabs. In U.S. Patent Publication No. 2006/0094491, each ticket is preprinted with only one individually playable game.

Notwithstanding the technology discussed above, there is still a need to improve the efficiency of ticket dispensing so that the volume of paper devoted to ticket printing can be reduced even further, and the frequency of roll replacements or ticket stack replenishments in vending machines can be further reduced. The present invention addresses these needs.

BRIEF SUMMARY OF THE INVENTION

One preferred embodiment of the present invention provides a method of vending game tickets from a vending machine during a game play session. Each ticket is preprinted with a plurality of individually playable games, and each game has a game result. The games are associated with at least one deal of games that includes at least some games that have predetermined winning game results. One or more games on a ticket are electronically purchased in a current game play session in response to a request inputted into the vending machine from a patron. Less than all of the games on the ticket may be purchased during the current game play session. An indication of which games on the ticket have been purchased is electronically recorded in database records. The vending machine dispenses all tickets that are played, including tickets wherein less than all of the games on the ticket were purchased during the current game play session. The records of the database may be used to verify which of the games on each of the played tickets have been purchased in the game play session.

Another preferred embodiment of the present invention provides a method of vending game tickets from a vending machine during a game play session. Each ticket is preprinted with a plurality of individually playable games, and each game has a game result. The games are associated with at least one deal of games that includes at least some games that have predetermined winning game results. One or more games on a ticket are electronically purchased in a current game play session in response to a request inputted into the vending machine from a first patron. Less than all of the games on the ticket may be purchased during the current game play session. An indication of which games on the ticket have been purchased is electronically recorded in database records. At the end of the current game play session, an electronic determination is made as to whether all of the games on the currently played ticket have been purchased. If all of the games on the currently played ticket have not been purchased, then the currently played ticket is retained in the vending machine for purchase of one or more of the unpurchased games on the ticket in the next game play session. The one or more of the unpurchased games on the retained ticket are then electronically purchased in the next game play session in response to a request inputted into the vending machine from a second patron.

BRIEF DESCRIPTION OF THE DRAWINGS

The above summary, as well as the following detailed description of a preferred embodiment of the invention, will be better understood when read in conjunction with the following drawings. For the purpose of illustrating the invention, the drawings show embodiments that are presently preferred. It should be understood that the invention is not limited to the precise arrangements and instrumentalities shown. In the drawings:

FIG. 1 shows prior art single-ply pull tab tickets.

FIG. 4 is a sample of database records for use with preferred embodiments of the present invention.

FIG. 6 is another sample of database records for use with preferred embodiments of the present invention.

DETAILED DESCRIPTION OF THE INVENTION

Figure 2:
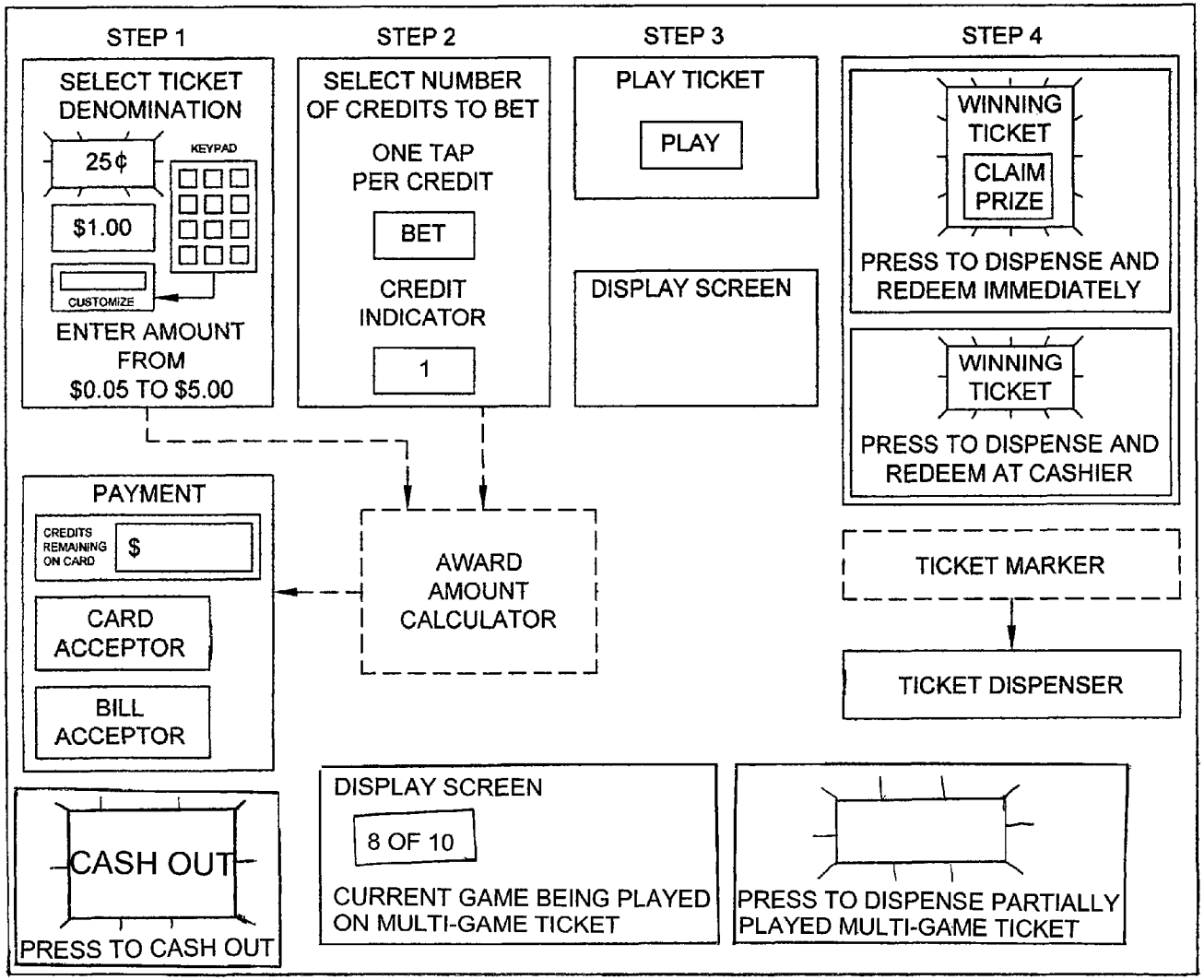
FIG. 2 shows selected elements on the face of a pull tab vending machine in accordance with one preferred embodiment of the present invention.

Certain terminology is used herein for convenience only and is not to be taken as a limitation on the present invention. In the drawings, the same reference letters are employed for designating the same elements throughout the several figures.

The tickets described with respect to the present invention are referred to as multiple game tickets. However, they differ from conventional multiple game tickets such as those shown in U.S. Pat. No. 5,735,432 because each game on the ticket must be individually purchased.

A pull tab machine for implementing the present invention may be similar to the machines described in U.S. Pat. Nos. 5,941,771 and 5,348,299 or the Lucky Tab II machine, with the additional features shown in FIG. 2 described below. The pull tab machines may dispense single-ply or two-ply tickets.

FIG. 2 is similar to the face of the pull tab vending machine described in U.S. Patent Publication No. 2006/0094491, and thus only its the additional features are described. The vending machine in FIG. 2 includes at least the following additional, optional features shown in the bottom portion of the face:

1. The display screen, which can be separate from, or part of, the original display screen, may include a display of the last game played on a multiple game ticket, here, game 8 of 10.

2. The face may include a button that can be pressed to dispense any partially played ticket. The button is preferably made active only when there are unpurchased (i.e., unplayed) games left on the previously played ticket, as shown in the display screen described above, and (i) the current patron has ended their game play session, or (ii) a new patron game play session has begun but no games have yet been played. In the first instance, the patron may wish to receive the ticket as a receipt of game play, even though there are unpurchased games on the ticket. In the second instance, the new patron may wish to start the game play session with their own new ticket by clearing the vending machine of the previous patron's unfinished ticket. The button is preferably not made active during a game play session to prevent the current patron from dispensing an actively played ticket with unpurchased games, and thereby waste game plays.

3. The "Winning Ticket" buttons in step 4 refer to the presence of at least one winning game on the multiple game ticket that has been played. (In U.S. Patent Publication No. 2006/0094491, there is only one game on a ticket.)

In an alternative embodiment of the present invention, one or both of these features are not employed, and the vending machine is programmed to automatically perform in a certain manner when the above-discussed conditions occur. For example, the vending machine may be programmed to never dispense unfinished tickets that have no winning games that have been played, thereby maximizing the advantage of the present invention in reducing the frequency of reel replacements or ticket stack replenishments. The vending machine may be programmed to only allow the current patron to receive the currently played ticket at the end of a game play session, but not to allow a new patron to clear out a previous patron's unfinished ticket. Some of these choices will depend upon jurisdictional requirements and capabilities of the vending machine, such as (i) whether the played ticket must be physically dispensed to the patron, even if only partially played, (ii) whether the vending machine has other ways to provide a patron with a receipt of game play, and (iii) whether ticket cashing is permitted at remote locations, such as a cashier, or must be performed at the vending machine. If ticket cashing is permitted at a remote location, then a ticket with a winning game must be physically given to the patron for presentation at the remote location.

Figure 3A:
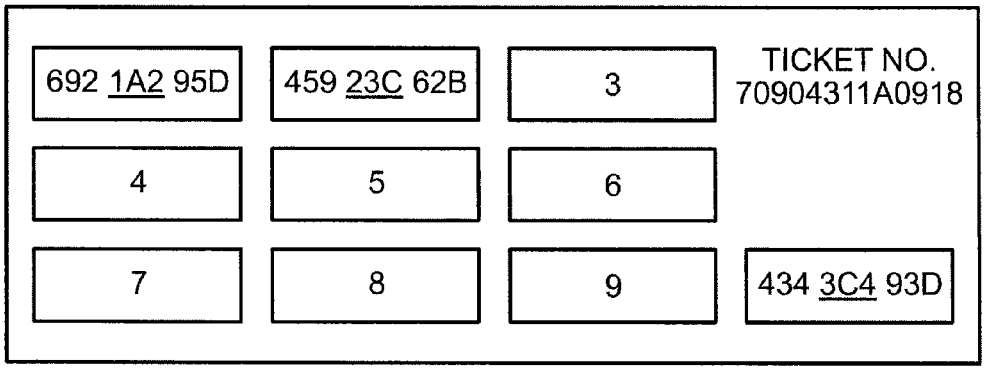
FIGS. 3A and 3B show the front and back of a multiple game ticket for use with preferred embodiments of the present invention.
Figure 3B:
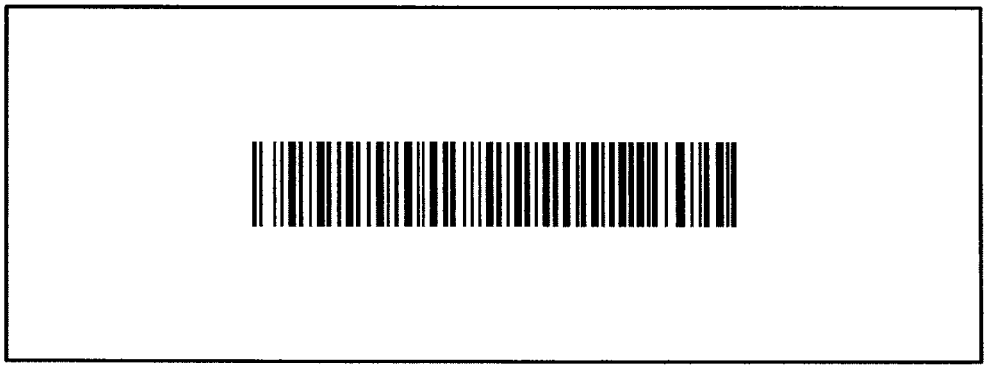

FIGS. 3A and 3B, taken together, show a preferred embodiment of a game ticket for use in the present invention. The game ticket preferably has a form factor similar to the game ticket shown in FIG. 1, although other form factors are within the scope of the present invention. In one preferred embodiment, each game ticket has a height of about one inch and a width of about three inches. The game ticket is preprinted with a plurality of individually playable games, each game having a game result. The game ticket shown in FIGS. 3A and 3B has ten games. However, the scope of the present invention includes any plurality of games. FIG. 3A shows the game values of the first, second and tenth games, with the remaining games represented by a number. The game ticket has its own individual ticket number. FIG. 3B shows the back of the game ticket which preferably includes machine readable indicia, here, a bar code, that can be used by the vending machine to electronically identify the individual ticket number.

FIG. 4 shows sample database records that further explain how the ticket indicia is used. The database records may be maintained in one or more databases at one or more locations. For convenience, FIG. 4 shows all of the database records in one table. Each ticket number/bar code number (column 1) has a plurality of games associated therewith, here, ten games, each having a unique game number (column 2). Each game number has an associated game value (column 3). As discussed above, different strings of alphanumeric characters represent different symbols. Each game has a predetermined game result, which is either a winner of a predetermined amount or a loser (column 4). Records are also kept regarding whether each game was purchased (i.e., played) (column 5), whether a winning ticket was redeemed (column 6), and the location of redemption (column 7). If redemption of winning tickets occurs automatically at vending machine, then at least column 7 would not be necessary, and column 6 would be optional, since column 5 may be used as a proxy value indicating that a purchased ticket was redeemed.

Figure 5:
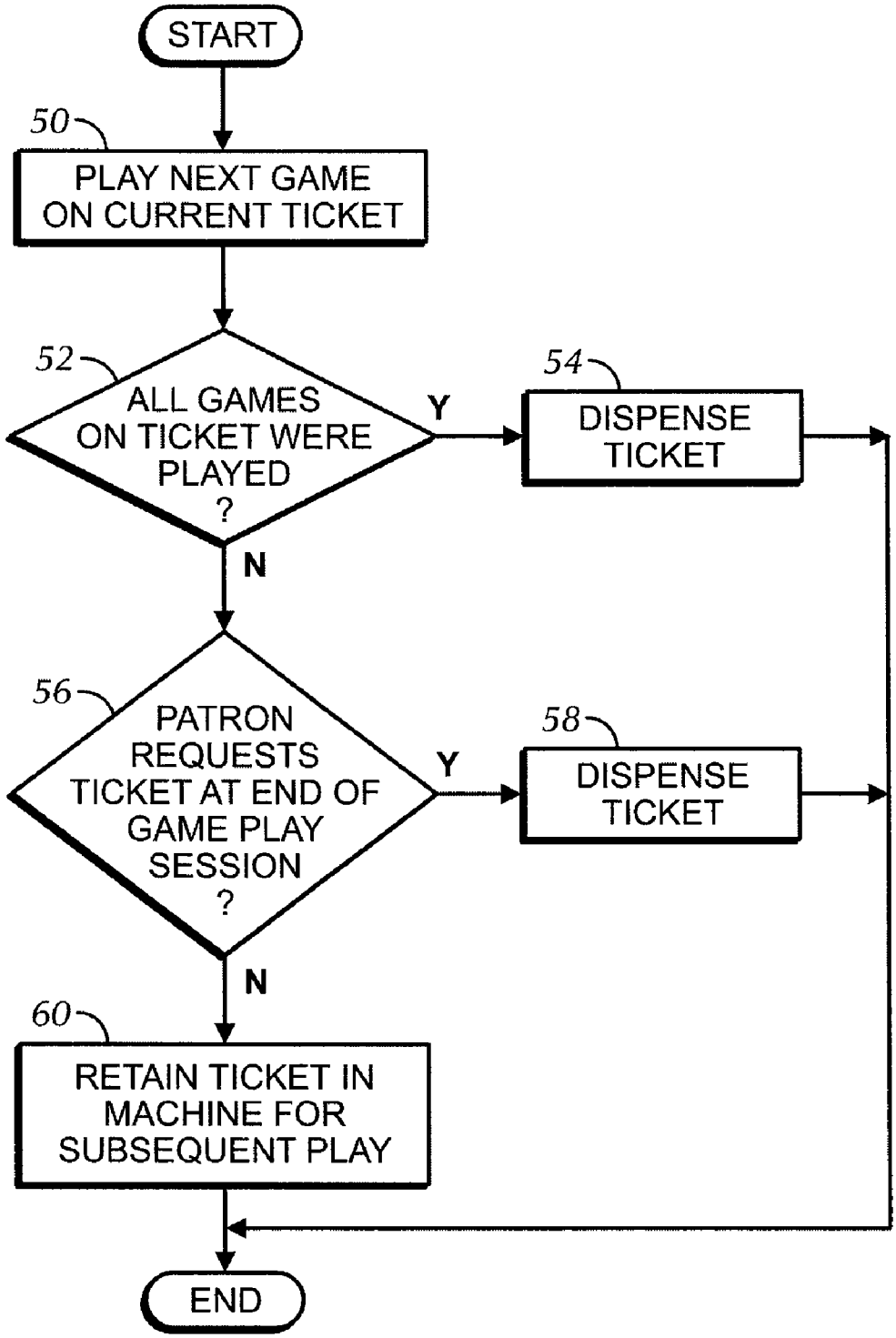
FIG. 5 is a flowchart of game play actions in accordance with one preferred embodiment of the present invention.

FIG. 5 shows a flowchart of a sample process that occurs during a patron's game play session. During game play, the next game on the current ticket is played (step 50). If all games on a ticket have been played (e.g., ten games in the example provided herein), the ticket is automatically dispensed into the ticket dispenser of the vending machine (steps 52, 54), either immediately, or upon ending of the patron's game play session. If all games on the ticket have not yet been played, but the patron requests to receive the ticket at the end the game play session, such as by pressing the button shown in FIG. 2, the ticket is automatically dispensed into the ticket dispenser of the vending machine (steps 56, 58). If all games on the ticket have not been played and the patron has not requested that the ticket be dispensed at the end of the game play session, then the ticket is retained in the vending machine for subsequent play in the next game play session (step 60), which may be played by the current patron or a different patron.

A game play session may be initiated and terminated either actively or passively. One active manner of initiating a game play session is by loading credits into the vending machine in preparation for game play in conjunction with an electronic card, as described in U.S. Patent Publication No. 2006/0094491. To initiate game play using the vending machine in FIG. 2, a patron inserts the card into the card acceptor. The card may be a stored value card which maintains a stored value amount in electronic format on the card, such as in a magnetic (mag) stripe. Alternatively, the card may have only account identification information and the card reader may be in communication with a remote database of account information. If the card or the account associated with the card has a zero balance, the patron inserts money into a bill acceptor to charge up the card or the account with credits. Each credit is associated with a fixed dollar value (e.g., 1 credit=$0.25 as a default value). The patron is now ready to purchase games on a ticket. One active manner of terminating a game play session is for the player to perform a cash out operation, which may also involve removing the card that was originally inserted into the card acceptor, or pressing a "cash out" button.

A game play session may be initiated and terminated in a passive manner merely by using the presence or absence of game credits as a proxy for initiation and termination of the session. That is, when game credits are initially loaded into the vending machine, such as by loading money into the bill acceptor, this action signals the initiation of a game play session. When no more game credits exist, this signals the termination of a game play session unless more money is inserted within some predetermined time period.

If no game credits are left on the vending machine but all games on the current ticket have not been played, the display screen may prompt the patron with a message such as "Insert x dollars to play remaining games on the ticket or press button to dispense ticket," wherein x is the value required to complete the remaining games on the ticket, and the button refers to the button in FIG. 2 that reads "Press to Dispense Partially Played Multi-Game Ticket." If a cash out button is provided and the patron presses the cash out button before all games on the current ticket have been played, a similar message may appear. In this manner, even if a patron has remaining credits, they will be given an opportunity to complete a partially played ticket.

Other embodiments for initiating or terminating a game play session are within the scope of the present invention, such as by providing dedicated buttons for communicating such an intent to the vending machine.

The following alternative embodiments may be performed:

1. If there is a winning game on the ticket and all games on the ticket have not yet been played, the options in step 4 of FIG. 2 are provided. The patron may also choose to continue to play more games on the current ticket which will automatically get dispensed upon completion of the last game on the ticket.

2. If all games on a ticket have not been played and the patron has not ended the game play session, the patron may nonetheless still request that the current ticket be dispensed. This is a less preferred embodiment because it causes unplayed games to be wasted because the unplayed games never get played, thereby defeating one of the benefits of the present invention.

To maximize the number of games played per ticket, patrons would be prevented from, or discouraged from, starting with new tickets by dispensing partially purchased tickets that are still in the vending machine, and likewise would be prevented from, or discouraged from, dispensing partially purchased tickets that the current patron has just played.

FIG. 6 shows sample database records that further explain the process in FIG. 5. FIGS. 4 and 6 show the same tickets, but illustrate the different manner in which the games are purchased, or not purchased, depending upon the game play sequence of patrons. For ease of illustration, FIGS. 4 and 6 presume that the process begins with a first patron and that there are no previously played games on the current ticket to be played. Also, the indication of when a game play session has ended for a particular patron is not shown in these figures.

In FIG. 4, games 2-10 of the first ticket were not purchased and thus will never get played. Likewise, game 10 of the second ticket was not purchased and will never get played. FIG. 6 shows a different game play sequence that results in all games of the first ticket being purchased, but only the first game in the second ticket being purchased.

In the game play of FIG. 4, one of the following two scenarios occurred to cause games 2-10 of the first ticket to not get purchased.

1. The first patron purchased one game on the first ticket, ended the game play session, and requested to receive the ticket for use as a receipt.

2. The first patron purchased one game on the first ticket, ended the game play session, and did not request to receive the ticket, but then a second patron requested to start game play with a new game ticket that has no previously purchased games. This caused the current unfinished ticket to be dispensed into the ticket dispenser.

Referring again to FIG. 4, the second patron then purchased nine games on the second ticket, ended the game play session, and requested to receive the ticket so that the one winning game could be redeemed at a cashier station. Accordingly, the tenth game on the second ticket did not get purchased.

In FIG. 6, the first patron purchased the first seven games on the first ticket (which were all losers), ended the game play session, and did not request to receive the ticket. The second patron either did not request to start game play with a new ticket or was not given the option of doing so, and instead continued game play with the eighth game (see game 8 of 10 indication on the display screen of FIG. 2) and purchased all of the remaining games on the first ticket, as well as the first game on the second ticket. The second patron then ended the game play session and requested to receive the second ticket, thereby preventing games 2-9 from being purchased. FIG. 6 illustrates one of the advantages of the present invention in that the unpurchased games from one ticket can, in many instances, be purchased by a subsequent patron, thereby reducing the number of tickets that get played for a given dollar amount of game play.

As discussed above, jurisdictional requirements and/or the capabilities of the vending machine may require that all played ticket be physically dispensed to the patron, even if the ticket is only partially played (i.e., if the ticket has one or more unplayed games). An alternative embodiment of the present invention implements this process. In this manner, the second patron always begins game play with a new ticket and thus does not complete the games on the unfinished ticket of the first patron. In this embodiment, once all games on a ticket are played, the ticket is dispensed to the patron. If a game play session is terminated either actively or passively, as discussed above, and the currently played ticket has unplayed games, the ticket is still dispensed. As discussed above, the patron may be prompted with a message to complete the ticket before it is automatically dispensed by the vending machine or before the patron requests that the ticket be dispensed.

Figure 7:
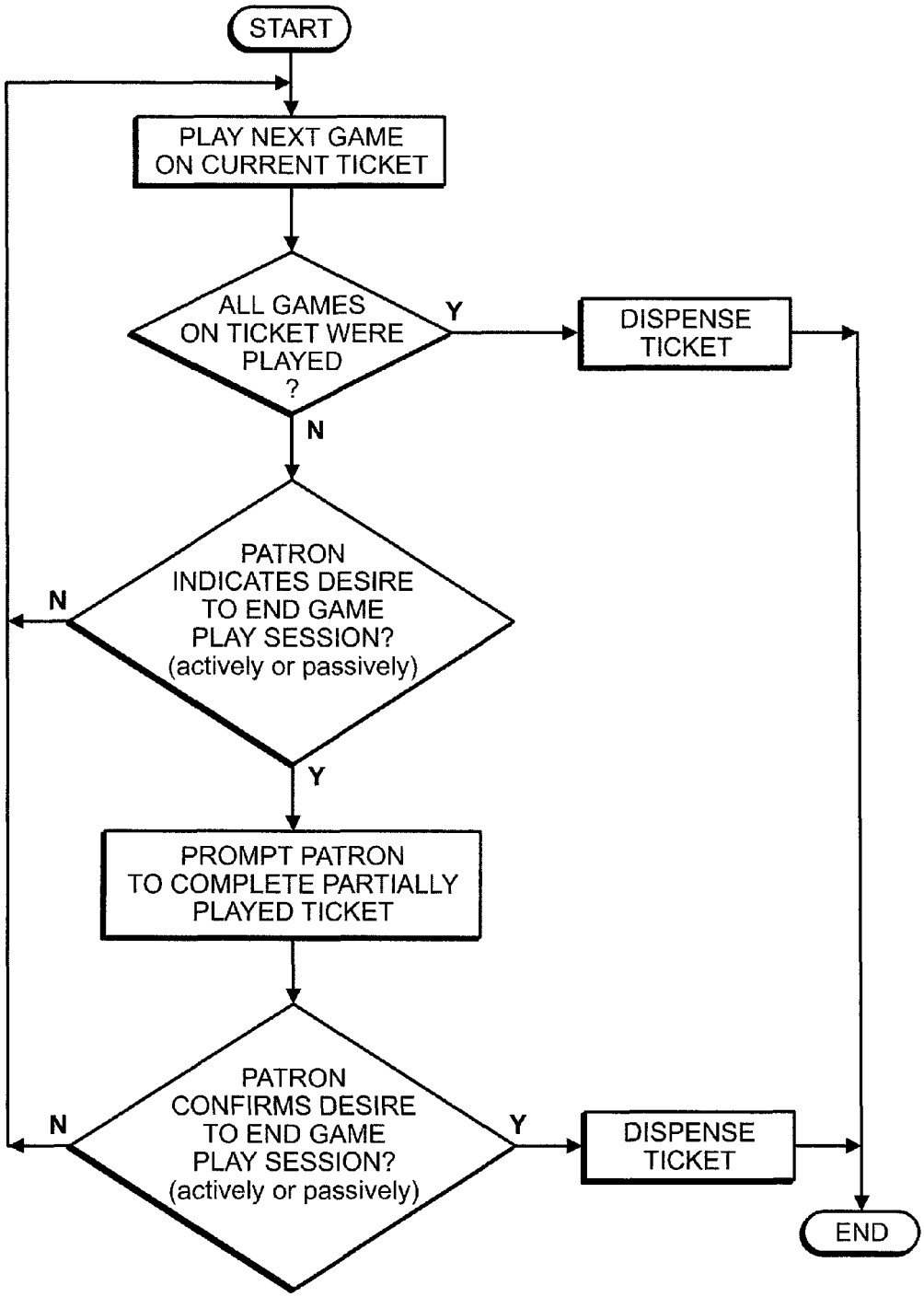
FIG. 7 is a flowchart of game play actions in accordance with another preferred embodiment of the present invention.

FIG. 7 is a self-explanatory flowchart directed to this alternative embodiment.

In this alternative embodiment, the database records would appear similar to the records shown in FIG. 4. However, the "Purchased?" status would be the result of the following different set of actions:

1. First patron plays only one game on the first ticket before terminating the game play session. The remaining unplayed games 2-9 never get purchased.

2. Second patron plays nine of the ten games on the second ticket before terminating the game play session. The remaining unplayed game 10 never get purchased.

If a patron successively plays out a plurality of tickets (i.e., plays all ten games of a succession of tickets), then the "Purchased?" status would reflect a continuous series of "Y"s.

Unless a ticket with unpurchased games is dispensed, the games are played in sequential order based on the order of their respective tickets in the reel or stack in the vending machine. If tickets are drawn from multiple reels or stacks in the vending machine, the order for each respective reel or stack is still maintained.

The present invention is described in the context of pull tab tickets. However, the scope of the present invention also includes generic tickets, such as instant game tickets (e.g., scratch off lottery tickets). These tickets are also conventionally preprinted in fixed denominations based on electronic deals and can be printed as multiple game tickets.

As shown in FIG. 3B, the tickets described above typically include a bar code which is captured upon dispensing and is used in one or more of the following ways:

1. If the bar code contains an encoding of the ticket contents, the bar code is decoded and the game contents are presented on the display screen of the vending machine as the respective individual games are played.
2. If the bar code does not contain the game results but instead contains an identification number, the number is used as a pointer to locate the multiple game results in a remote database. The multiple game results are then relayed back to the vending machine for display as the respective individual games are played. This method is preferred because only a limited amount of information can be encoded in bar codes, and there is a large amount of information associated with ten game values and corresponding game results. This method also allows for easy expansion of the invention for even larger numbers of games per ticket since the same bar code can be used, regardless of the number of games per ticket.

The tickets used in the present invention may be dispensed from a continuous roll or sheet, or they may be printed on separate sheets of printed media and dispensed from a stack.

The vending machine in FIG. 2 may dispense only multiple game tickets, or may dispense multiple game tickets and single game tickets.

Instead of tickets being printed with different strings of alphanumeric characters that represent different symbols, the actual symbols may be printed instead.

The present invention may be implemented with or without the multi-bet features of U.S. Patent Publication No. 2006/0094491. For convenience and speed of playing, the multi-bet aspects are preferably set on a ticket by ticket basis or a patron session by session basis, and not on a game by game basis. However, the scope of the present invention includes the game by game basis capability.

The present invention may use some or all of the other features of the vending machine described in U.S. Patent Publication No. 2006/0094491, such as the ticket marking feature.

The vending machine is preferably associated with a bank of vending machines connected to a remote server (not shown) via an electronic network. Some or all of the parts of the database may be located at the remote server.

Since the database maintains a record of whether a game was purchased or not purchased, it is not necessary to make any markings on dispensed tickets regarding which games on the tickets were purchased or not purchased. Thus, if a patron is in possession of a ticket having unpurchased winning games, the database provides an indication that no money should be paid to the patron for those games. Alternatively, ticket markings may be made on any dispensed tickets for the visual convenience of the patron or cashier to indicate which games were purchased or not purchased.

In one preferred embodiment, the database is pre-populated with an "N" indication for all unpurchased games loaded into vending machines, and then as games are purchased, the "N" indications are changed to "Y" indications, or an equivalent thereof. Any games that are skipped due to dispensing a ticket with unpurchased, and thus unplayed, games, simply remain in the "N" status. In an alternative embodiment, the database uses three different designations, namely, "Y" for purchased, "N" for skipped and unpurchased, and a third or blank designation for games that have not yet been reached in the sequence, and thus are neither played or skipped and unplayed. The three designations allow for tighter audit control since there will be some potential ambiguity with the embodiment that uses only "Y" and "N" indications because "N" can mean two different things, namely, that the game was skipped and unpurchased or that the game was not yet reached in the sequence. The ambiguity will be most evident for the games near the last played games since they could legitimately be in either status. If tickets are properly played in the sequence in which they are loaded into the vending machine, then only the games near the last played games would have this ambiguity. However, if tickets can be drawn from multiple reels or stacks within the vending machine as described above, or if loose tickets are physically shuffled before being stacked into the vending machine, then it may be preferred to use three designations to provide better audit control.

In the embodiments described above, a ticket having a winning game result is redeemable for a currency-related prize (e.g., $1, $5). In an alternative embodiment, a ticket having a winning game result is redeemable for a non-currency-related prize. The actual prize would be stored in the Game result field of the database records and would preferably be displayed on the display screen of the vending machine after the game on the ticket is played. In this embodiment, the cashier station may alternatively be a prize counter. If the vending machine is not equipped to physically dispense non-currency related prizes, then the vending machine would display a message informing the patron to redeem the winning ticket at the cashier station or prize counter. If the vending machine is equipped to physically dispense non-currency related prizes, then the patron would have the same two choices described above for redeeming a currency-related prize, namely to redeem at the vending machine or redeem at a cashier/prize counter.

In the embodiment described above, if a winning ticket is present, the patron selects the option of dispensing and immediately redeeming the winning ticket or dispensing the winning ticket for subsequent redemption at a cashier (STEP 4). If the patron selects the option of dispensing and immediately redeeming the winning ticket, the amount of the winning ticket is automatically added to the credit meter or dispensed in cash as the ticket is dispensed, depending upon the capabilities of the vending machine, and how it is configured. In an alternative embodiment, the patron may be provided with an option to merely dispense the winning ticket without being automatically redeemed, and then the patron may decide when and where the winning ticket will be redeemed (i.e., at the vending machine, such as by having the vending machine read the bar code of the ticket, or by bringing the ticket to a cashier for redemption).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A method of vending game tickets from a vending machine during a game play session, each ticket being preprinted with a plurality of individually playable games, each game having a game result, the games being associated with at least one deal of games that includes at least some games having predetermined winning game results, the method comprising:

(a) electronically purchasing one or more games on a ticket in a current game play session in response to a request inputted into the vending machine from a patron, wherein less than all of the games on the ticket may be purchased during the current game play session;

(b) electronically recording in database records an indication of which games on the ticket have been purchased; and (c) dispensing from the vending machine all tickets that are played, including tickets wherein less than all of the games on the ticket were purchased during the current game play session, and wherein the records of the database may be used to verify which of the games on each of the played tickets have been purchased in the game play session.

2. The method of claim 1 wherein for each game play session, step (c) further comprises:

(i) automatically dispensing each ticket after completion of all games on the ticket, and (ii) dispensing a partially played ticket if such a ticket exists at the end of the current game play session.

3. The method of claim 2 further comprising:

(d) prior to step (c)(ii), prompting the patron to play the remaining games on the partially played ticket.

4. The method of claim 1 wherein during each game play session, games on a new ticket are played only after all unpurchased games are played on the currently played or retained ticket.

5. The method of claim 1 wherein the vending machine includes a display screen, the method further comprising:

(d) displaying on the display screen an indication of which games on the currently played ticket have been played during the current game play session.

6. The method of claim 1 wherein each game ticket has ten games thereon.

7. The method of claim 1 wherein the tickets are pull tab tickets.

8. The method of claim 1 wherein the tickets are instant win lottery tickets.

9. The method of claim 1 wherein the games are purchased sequentially on each ticket.

10. A method of vending game tickets from a vending machine during a game play session, each ticket being preprinted with a plurality of individually playable games, each game having a game result, the games being associated with at least one deal of games that includes at least some games having predetermined winning game results, for at least some of the game tickets, the method comprising:

(a) electronically purchasing one or more games on a ticket in a current game play session in response to a request inputted into the vending machine from a first patron, wherein less than all of the games on the ticket may be purchased during the current game play session;

(b) electronically recording in database records an indication of which games on the ticket have been purchased;

(c) electronically determining at the end of the current game play session if all of the games on the currently played ticket have been purchased;

(d) retaining the currently played ticket in the vending machine for purchase of one or more of the unpurchased games on the ticket in the next game play session if all of the games on the currently played ticket have not been purchased; and (e) electronically purchasing one or more of the unpurchased games on the retained ticket in the next game play session in response to a request inputted into the vending machine from a second patron.

11. The method of claim 10 wherein during each game play session, games on a new ticket are played only after all unpurchased games are played on the currently played or retained ticket.

12. The method of claim 10 wherein the first and second patron may be the same patron.

13. The method of claim 10 further comprising:

(f) automatically dispensing the currently played ticket if all of the games on the currently played ticket have been purchased.

14. The method of claim 10 wherein if upon conclusion of a patron's current game play session it is determined that all of the games on a currently played ticket have not been purchased, the method further comprising:

(f) receiving a request from a patron for inputting into the vending machine to receive the retained currently played ticket, wherein the records of the database may be used to verify which of the games on the currently played ticket have been purchased in the current game play session; and (g) automatically dispensing the retained currently played tickets from the vending machine.

15. The method of claim 10 wherein upon initiation of a new game play session by a patron, the method further comprising:

(f) receiving a request from the patron for inputting into the vending machine to start a new game ticket that has no previously purchased games; and (g) automatically dispensing any retained previously played ticket from the vending machine.

16. The method of claim 10 wherein the vending machine includes a display screen, the method further comprising:

(f) displaying on the display screen an indication of which games on the currently played ticket have been played during the current game play session.

17. The method of claim 10 wherein each game ticket has ten games thereon.

18. The method of claim 10 wherein the tickets are pull tab tickets.

19. The method of claim 10 wherein the tickets are instant win lottery tickets.

20. The method of claim 10 wherein the games are purchased sequentially on each ticket.

* * * * *